US006176441B1

(12) United States Patent
Munezane et al.

(10) Patent No.: US 6,176,441 B1
(45) Date of Patent: Jan. 23, 2001

(54) IN-CYLINDER FUEL INJECTION VALVE

(75) Inventors: Tsuyoshi Munezane, Hyogo; Mamoru Sumida, Tokyo, both of (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/400,839

(22) Filed: Sep. 21, 1999

(30) Foreign Application Priority Data

Apr. 7, 1999 (JP) ..... 11-100659

(51) Int. Cl.[7] ..... B05B 1/30; F02M 51/00

(52) U.S. Cl. ..... 239/585.1; 239/533.12; 239/585.4; 239/585.5

(58) Field of Search ..... 239/533.12, 585.1, 239/585.2, 585.4, 585.5

(56) References Cited

U.S. PATENT DOCUMENTS 4,887,769 * 12/1989 Okamoto et al. ..... 239/585.5 X
5,871,157 2/1999 Fukutomi et al. ..... 239/463
5,954,274 * 9/1999 Sumida et al. ..... 239/585.4 X
5,979,801 * 11/1999 Munezane ..... 239/585.5 X

FOREIGN PATENT DOCUMENTS 2-215963 8/1990 (JP) .
10-47208 2/1998 (JP) .
10-47209 2/1998 (JP) .

* cited by examiner

*Primary Examiner*—Andres Kashnikow
*Assistant Examiner*—Robin O. Evans
(74) *Attorney, Agent, or Firm*—Sughrue, Mion, Zinn, Macpeak & Seas, PLLC

(57) ABSTRACT

An in-cylinder fuel injection valve which can realize perfectly hollow conical spray with the minimum amount of center spray.

When the outer diameter of a portion of a valve supported by a turning body in such a manner that it can move in an axial direction is represented by D1, the inner diameter of a center hole is represented by D2 and the outer diameter of an inner annular groove is represented by D3, $2\times(D2-D1)<D3-D1$, and the total of the volume of a space surrounded by a valve seat, the turning body and the valve when the valve is closed and the volume of the inner annular groove is set to 0.25 $mm^3$ or less.

1 Claim, 15 Drawing Sheets

IN-CYLINDER FUEL INJECTION VALVE

BACKGROUND OF THE INVENTION

1. Field of the Invention

The present invention relates to an in-cylinder fuel injection valve for directly injecting fuel into the combustion chamber of an internal combustion engine from an injection port by turning the fuel.

2. Description of the Prior Art

FIG. 8 is an axial direction sectional view showing a fuel injection valve disclosed by Japanese Laid-open Patent Application No. 2-215963, and FIG. 9 is a perspective view showing a turning body in the fuel injection valve of FIG. 8. In FIG. 8, reference numeral 51 denotes a valve housing, 52 a solenoid unit installed in the valve housing 51, 53 the core of the solenoid unit 52, 54 the electromagnetic coil of the solenoid unit 52, 55 the plunger of the solenoid unit 52, 56 the spring force control bar of the solenoid unit 52, 57 the spring of the solenoid unit 52, 58 the terminal of the solenoid unit 52, 59 a valve unit attached to an end portion of the valve housing 51 in such a manner that it becomes coaxial to the solenoid unit 52, 60 the valve body of the valve unit 59, 61 the ball valve of the valve unit 59, 62 a valve seat formed in the valve body 60, 63 an injection port formed in the valve body 60, 64 the turning body of the valve unit 59, 65 a center hole formed in the turning body 64 to support the ball valve 61 so that it can move in an axial direction, 66 a vertical passage formed around the turning body 64, 67 turning grooves formed in the valve body side of the turning body 64, 68 a fuel supply hole formed in the valve housing 51, 69 a fuel passage formed in a space between the valve housing 51 and the solenoid unit 52, and 70 a fuel pipe fitted onto the valve housing 51. In FIG. 9, the turning grooves 67 are connected to the injection port 63 eccentric to the center of the turning body 64.

A description is subsequently given of the operation of the above prior art. Fuel is guided into the turning grooves 67 from the fuel pipe 70 through the fuel supply hole 68, the fuel passage 69 and the vertical passage 66. When electricity to be supplied from the terminal 58 to the electromagnetic coil 54 is cut, the plunger 55 is pressed by the spring force of the spring 57, and the ball valve 61 contacts the valve seat 62 to stop a flow of fuel from the turning grooves 67 to the injection port 63. When electricity is applied to the electromagnetic coil 54 from the terminal 58 while the valve unit 59 is thus closed by the spring force of the spring 57, a magnetic circuit is formed by the electromagnetic coil 54, the core 53, the valve housing 51 and the plunger 55, the plunger 55 and the ball valve 61 are magnetically attracted toward the core 53 side, and an annular space is formed between the ball valve 61 and the valve seat 62. That is, when the valve unit 59 is opened by the electromagnetic attraction of the solenoid unit 52, the annular space is formed between the ball valve 61 and the valve seat 62 and fuel is injected into the injection port 63 through the annular space from the turning grooves 67. Since the turning grooves 67 are eccentric to the center of the turning body 64, fuel turns along the lower peripheral surface of the ball valve 61 from the turning grooves 67, passes through the annular space and is injected from the injection port 63 in a conical spray form having a predetermined angle.

FIG. 12 is an axial direction sectional view showing a in-cylinder fuel injection valve disclosed by Japanese Laid-open Patent Application No. 10-47208. In FIG. 12, reference numeral 1 denotes a first valve housing constituting a front half of a valve housing, 2 a second valve housing constituting a rear half of the valve housing and fixed coaxial to the rear end of the first valve housing 1, 3 a valve unit installed in the first valve housing 1, 4 a spacer set in the first valve housing 1, 5 an internal passage formed in the spacer 4, 6 a valve body installed in the first valve housing 1, 7 an internal passage formed in the valve body 6, 8 a storage chamber formed in the end portion of the valve body 6 such that it is coaxial to the internal passage 7 and having a diameter larger than that of the internal passage 7, 9 a needle valve as a valve stored in the spacer 4 and the valve body 6 through the internal passage 7 in such a manner that it can move in an axial direction, 10 a holder connected to the outer side portion of the end of the first valve housing 1 to fix the spacer 4 and the valve body 6 to the first valve housing 1, 11 the turning body of the valve unit 3 stored in the storage chamber 8, 12 a center hole formed in the turning body 11 to support the needle valve 9 such that it can move in an axial direction, 13 a horizontal passage formed along the top surface of the turning body 11, 14 a vertical passage formed around the turning body 11, 15 an inner annular groove formed annular in the under surface of the turning body 11 outside the center hole 12, and 16 turning grooves formed in the under surface of the turning body 11 such that they communicate with the vertical passage 14 and the inner annular groove 15. The turning grooves 16 are connected to the inner annular groove 15 tangentially.

Denoted by 17 is a valve seat stored and fixed airtightly in the storage chamber 8 of the valve body 6 in such a manner that it is placed under the turning body 11, 18 a valve seat surface formed on the top of the valve seat 17, 19 an injection port formed in the center of the valve seat 18 coaxial to the valve seat 17, and 20 a sealing member for the valve unit 3 fitted in a contact portion between the first valve housing 1 and the valve body 6 to prevent the leakage of fuel. Reference numeral 21 represents a solenoid unit installed in the first valve housing 1 and the second valve housing 2 such that it is coaxial to the valve unit 3, 22 a core installed in the first valve housing 1 and the second valve housing 2, 23 an internal passage formed in the core 22, 24 a sleeve fitted in the core 22 at an intermediate portion of the internal passage 23, 25 an internal passage formed in the sleeve 24, 26 a bobbin installed in the first valve housing and fitted onto the end portion of the core 22, 27 an electromagnetic coil fitted onto the bobbin 26, 28 a sealing member fitted in contact portions among the first valve housing 1, the core 22 and the bobbin 26 to prevent the leakage of fuel, and 29 an armature stored in the first valve housing 1 below the core 22 such that it can move an axial direction. The armature 29 supports the top portion of the needle valve 9. Denoted by 30 is an internal passage formed around the armature 29, 31 a spring inserted between the sleeve 24 and the armature 29 in the internal passage 23, 32 a terminal connected to the electromagnetic coil 27, 33 a filter installed in the internal passage 23 which is a fuel inlet portion, 34 a fuel pipe connected to the second valve housing 2 and the core 22 around the filter 33, and 35 the cylinder block of an internal combustion engine equipped with an in-cylinder fuel injection valve.

The valve unit 3 comprises the spacer 4, internal passage 5, valve body 6, internal passage 7, storage chamber 8, needle valve 9, turning body 11, center hole 12, horizontal passage 13, vertical passage 14, inner annular groove 15, turning grooves 16, valve seat 17, valve seat surface 18 and injection port 19. The solenoid unit 21 comprises the core 22, internal passage 23, sleeve 24, internal passage 25, bobbin 26, electromagnetic coil 27, armature 29, internal passage 30, spring 31 and terminal 32.

A description is subsequently given of the operation of the in-cylinder fuel injection valve shown in FIG. 12. Fuel is guided into the inner annular groove 15 from the fuel pipe 34 through the filter 33, internal passages 25, 23, 30, 5 and 7, horizontal passage 13, vertical passage 14 and turning grooves 16. When electricity to be applied from the terminal 32 to the electromagnetic coil 27 is cut, the armature 29 is pressed by the spring force of the spring 31, and the needle valve 9 is contacted to the valve seat surface 18 by the armature 29 to stop a flow of fuel from the inner annular groove 15 to the injection port 19. When electricity is applied to the electromagnetic coil 27 from the terminal 32 while the valve unit 3 is thus closed by the spring force of the spring 31, a magnetic circuit is formed by the electromagnetic coil 27, the core 22, the first valve housing 1 and the armature 29, the armature is magnetically attracted toward the core 22 side, the needle valve 9 moves up in an axial direction together with the armature 29, and an annular space is formed between the needle valve 9 and the valve seat surface 18. That is, when the valve unit 13 is opened by the electromagnetic attraction of the solenoid unit 21, the annular space is formed between the needle valve 9 and the valve seat surface 18 and fuel is injected into the injection port 19 from the inner annular groove 15 through the above annular space. Since the turning grooves 16 are connected to the inner annular groove 15 tangentially, fuel flowing into the inner annular groove 15 from the turning grooves 16 turns along the inner annular groove 15, passes through the above annular space and is injected from the injection port 19 in a conical spray form having a predetermined angle.

As for the fuel injection valve of FIG. 8, when the spray form of fuel injected from the injection port 63 through the turning grooves 67 and the annular space between the ball valve 61 and the valve seat surface 62 by the opening of the valve unit 59 caused by the electromagnetic attraction of the solenoid unit 52 was measured, the results shown in FIG. 10 and FIG. 11 were obtained. FIG. 10 and FIG. 11 are horizontal direction sectional views showing the spray forms of fuel injected from the injection port 63. In FIG. 10, the spray form 71 of fuel is polygonal influenced by the number of the turning grooves 67 as shown by slant lines and in FIG. 11, the spray form 72 of fuel is nonuniform in a circumferential direction and eccentric as shown by slant lines. From FIG. 10 and FIG. 11, the reason for the above spray forms is considered to be that fuel is not turned fully in the step where it flows into the annular space between the ball valve 61 and the valve seat surface 62 from the turning grooves 67 because the fuel injection valve of FIG. 8 has such a structure that the turning grooves are directly connected to the injection port 63 as described above.

As for the in-cylinder fuel injection valve of FIG. 12, when the spray form of fuel injected from the injection port 19 through the turning grooves 16, the inner annular groove 15 and the annular space between the needle valve 9 and the valve seat surface 18 by the opening of the valve unit 3 caused by the electromagnetic attraction of the solenoid unit 21 was measured, the results shown in FIG. 13 and FIG. 14 were obtained. FIG. 13 is an axial direction sectional view showing the spray form of fuel injected from the injection port 19 and FIG. 14 is a horizontal direction sectional view showing the spray form of fuel injected from the injection port 19. In FIG. 13 and FIG. 14, the spray form 38 of fuel is a perfect hollow cone having center spray 37 with the injection port 19 as a center. From FIG. 13 and FIG. 14, the reason for this spray form is considered to be that when the width of the inner annular groove 15 is larger than a predetermined value, fuel which is not turned when the valve unit 3 is opened is injected ahead, thereby generating center spray 37 in which fuel is not atomized, although fuel receives turning energy fully from the inner annular groove 15 and a uniform spray form 39 in a circumferential direction can be thereby obtained as shown by slant lines in FIG. 14 because the in-cylinder fuel injection valve of FIG. 12 has such a structure that the turning grooves 16 communicate with the injection port 19 through the inner annular groove 15 and are connected to the inner annular groove 15 tangentially.

As for the in-cylinder fuel injection valve of FIG. 12, when the spray distribution of fuel injected from the injection port 19 was measured, the results shown in FIG. 15 were obtained. This measurement was carried out by placing a plurality of concentric jigs having different diameters at each spray solid angle θ (see FIG. 13) from the center of spray coaxial to the injection port 19, 50 mm away from the injection port 19 and right below the injection port 19. The amount of spray received by these jigs which receive the spray of fuel injected from the injection port 19 was measured. FIG. 15 is a diagram showing the results of this measurement, plotting the proportion of the amount of spray received by each jig at each spray solid angle θ to the total amount of spray received by all the jigs. It is understood from FIG. 15 that the proportion of the amount of spray gradually decreases to 16 to 5.5% when the spray solid angle is 5 to 18°, sharply increases to 5.5 to 32% when the spray solid angle is 18 to 35°, becomes maximum at 32% when the spray solid angle is 35°, and sharply decreases to 32 to 10% when the spray solid angle is 35 to 45°.

As an example of combustion of fuel injected into the cylinders of an internal combustion engine, the spray of fuel is reflected by the top face of a piston and concentrated around an ignition plug to form a concentrated mixed gas and center spray which leads the implementation of the combustion of a formed layer may be necessary. However, in an internal combustion engine in which the best combustion is achieved by implementing perfectly hollow conical spray without using a system in which the spray of fuel is not reflected by the top face of the piston, it is ideal that the amount of center spray should be minimum.

SUMMARY OF THE INVENTION

It is an object of the present invention to provide an in-cylinder fuel injection valve which can realize perfectly hollow conical spray with the minimum amount of center spray.

According to the present invention, there is provided an in-cylinder fuel injection valve which comprises a hollow housing body which can be connected to a fuel supply pipe, a hollow cylindrical valve body installed in the housing body, a valve seat provided at one end of the valve body and having an injection port for a fluid in the center, a valve for opening and closing the injection port by contacting to and separating from this valve seat, a hollow cylindrical turning body which surrounds and supports the valve in such a manner that it can move in an axial direction and installed in the valve body such that it is placed upon the valve seat to turn fuel flowing into the injection port, a solenoid unit, installed in the housing body, for opening and closing the valve by contacting and separating the valve to and from the valve seat, a plurality of peripheral surface portions of the turning body for specifying the location of the turning body relative to the valve body, a vertical passage formed between the turning body and the valve body and between adjacent peripheral surface portions to form a passage of fuel in an axial direction, a center hole formed in the turning body to surround and support the valve in such a manner that it can move in an axial direction, an inner annular groove formed in the valve seat side of the turning body to surround the center hole coaxially, and turning grooves formed in the turning body such that they communicate with the inner annular groove and the vertical passage and are connected to the inner annular groove tangentially, wherein when the outer diameter of a portion of the valve supported by the turning body in such a manner that it can move in an axial direction is represented by D1, the inner diameter of the center hole is represented by D2 and the outer diameter of the inner annular groove is represented by D3, $2\times(D2-D1)<D3-D1$, and the total of the volume of a space surrounded by the valve seat, the turning body and the valve when the valve is closed and the volume of the inner annular groove is set to 0.25 $mm^3$ or less.

The above and other objects, features and advantages of the invention will become more apparent from the following description when taken in conjunction with the accompanying drawings.

BRIEF DESCRIPTION OF THE ACCOMPANYING DRAWINGS

DETAILED DESCRIPTION OF THE PREFERRED EMBODIMENT

Figure 1:
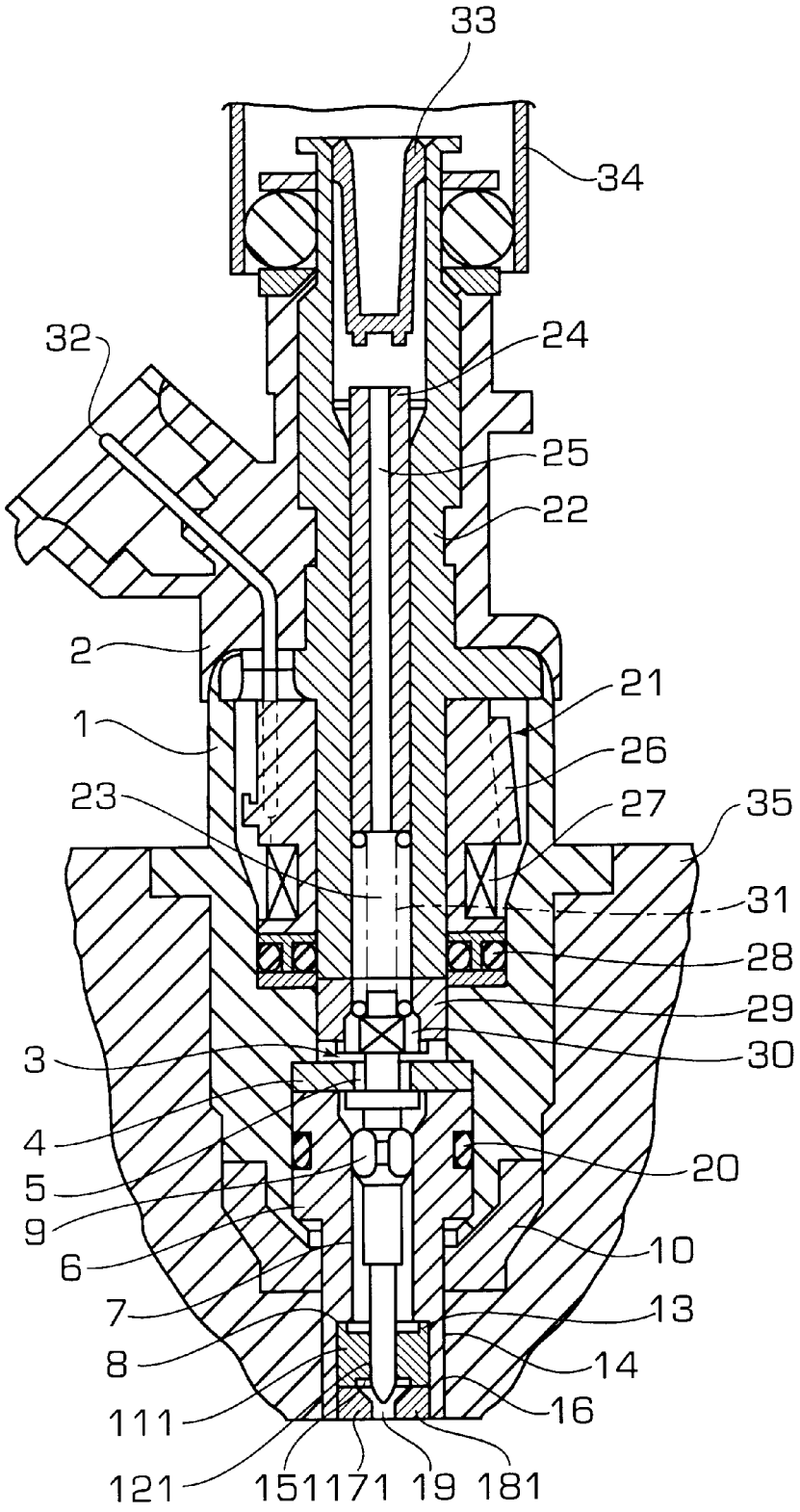
FIG. 1 is an axial direction sectional view of an in-cylinder fuel injection valve according to an embodiment of the present invention.
Figure 2:
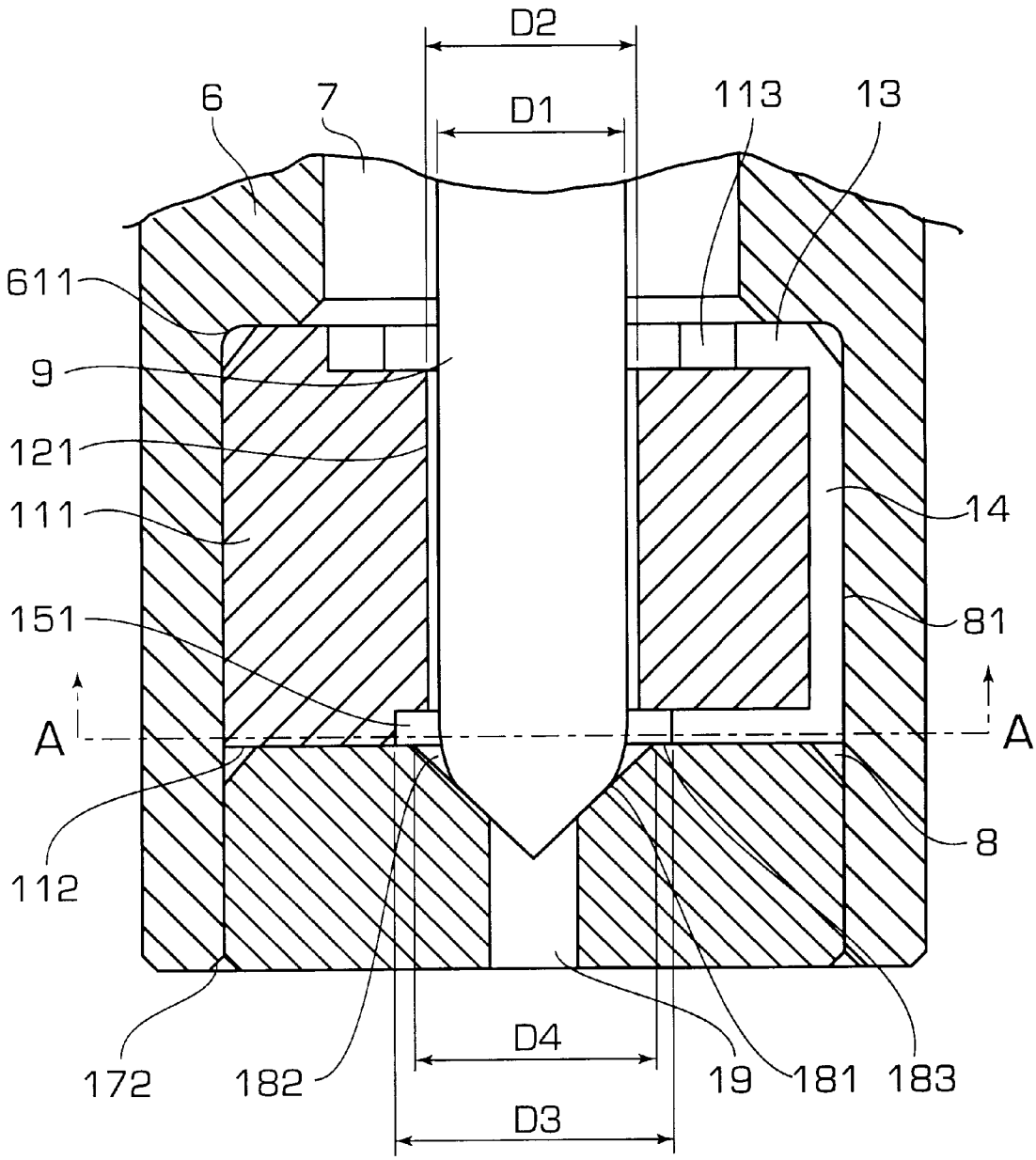
FIG. 2 is an axial direction sectional view of an end portion of a valve unit according to the above embodiment of the present invention.
Figure 3:
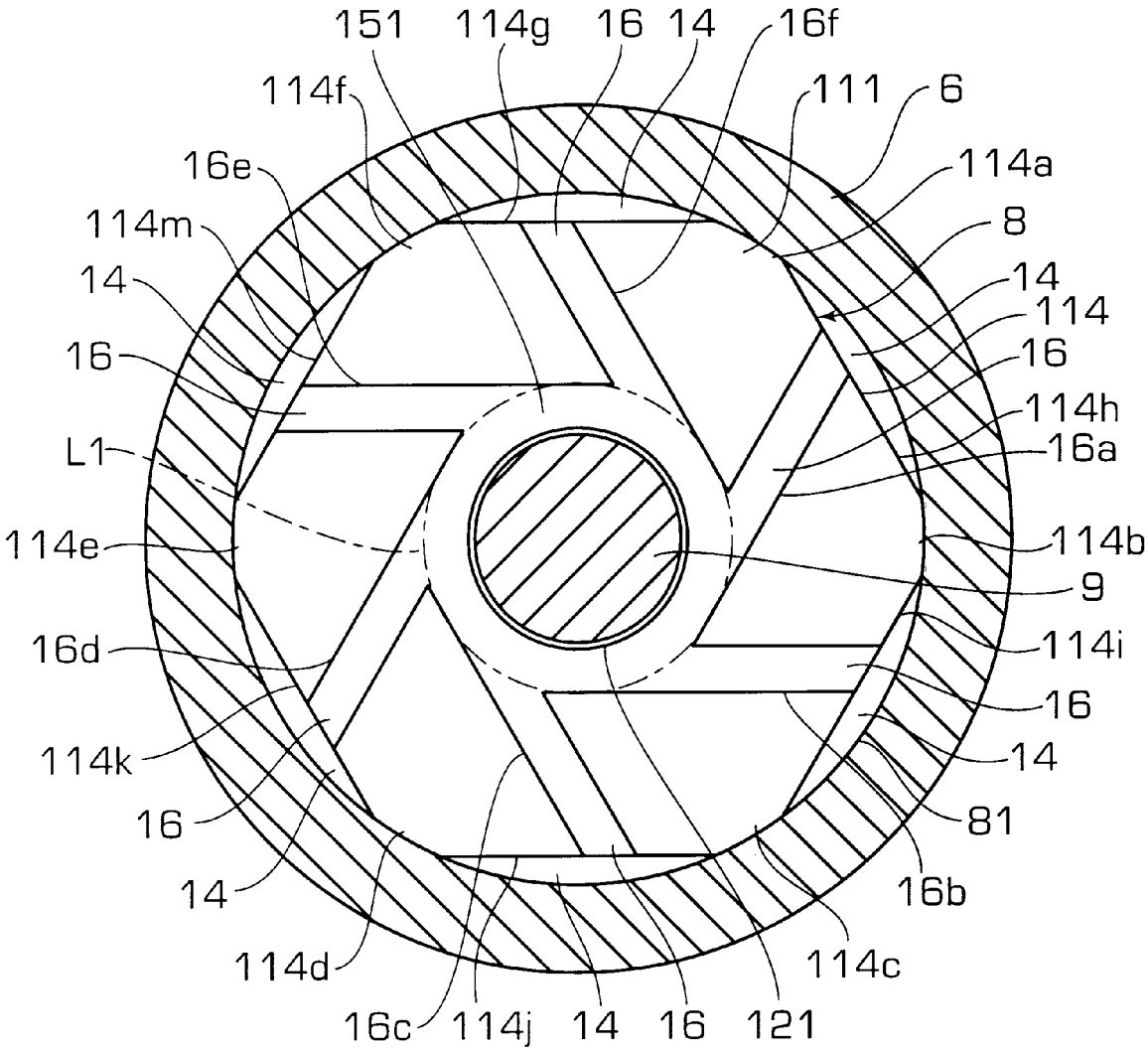
FIG. 3 is a horizontal direction sectional view of the end portion of the valve unit, corresponding to a section cut on line A—A of FIG. 1.
Figure 4:
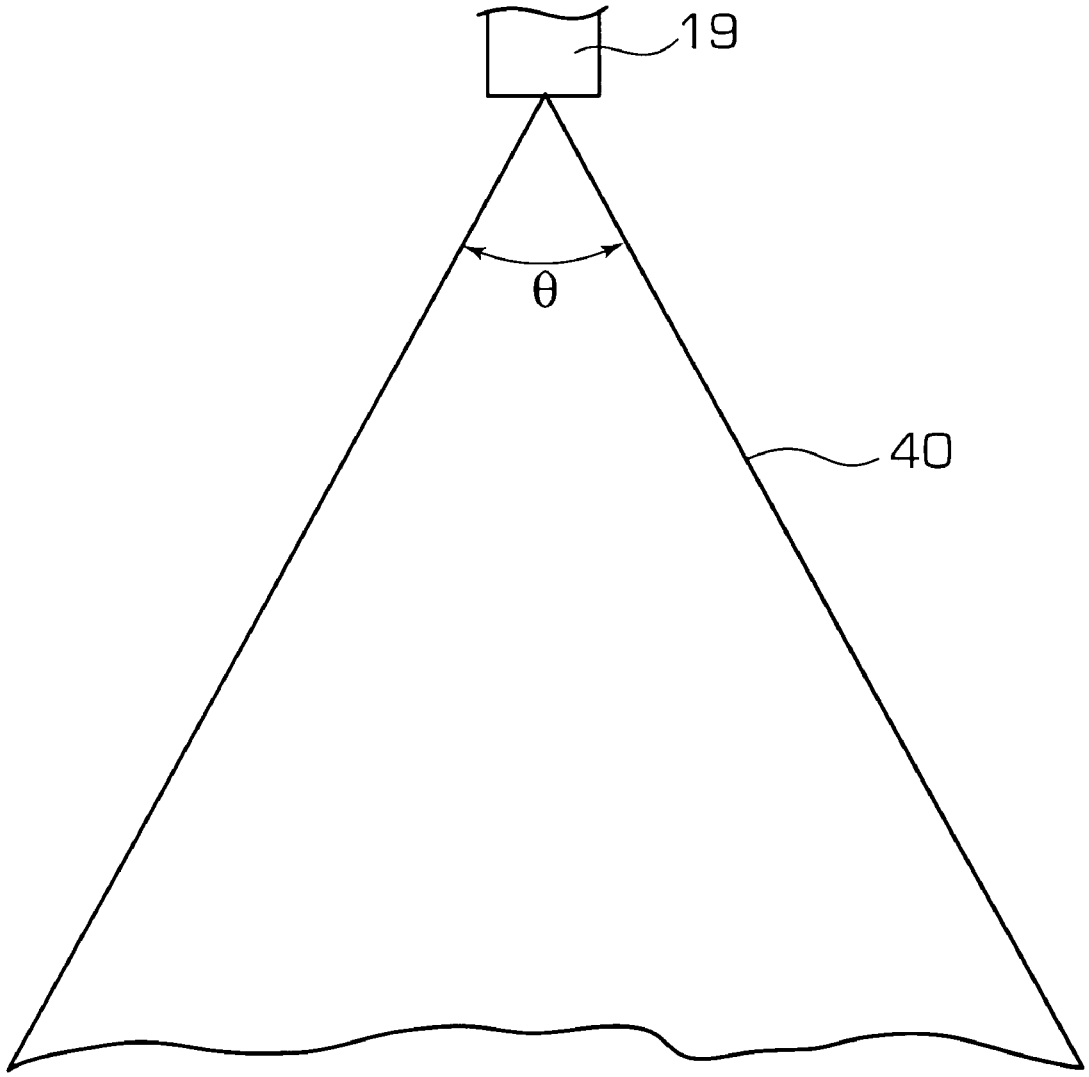
FIG. 4 is an axial direction sectional view of a spray form according to the above embodiment.
Figure 5:
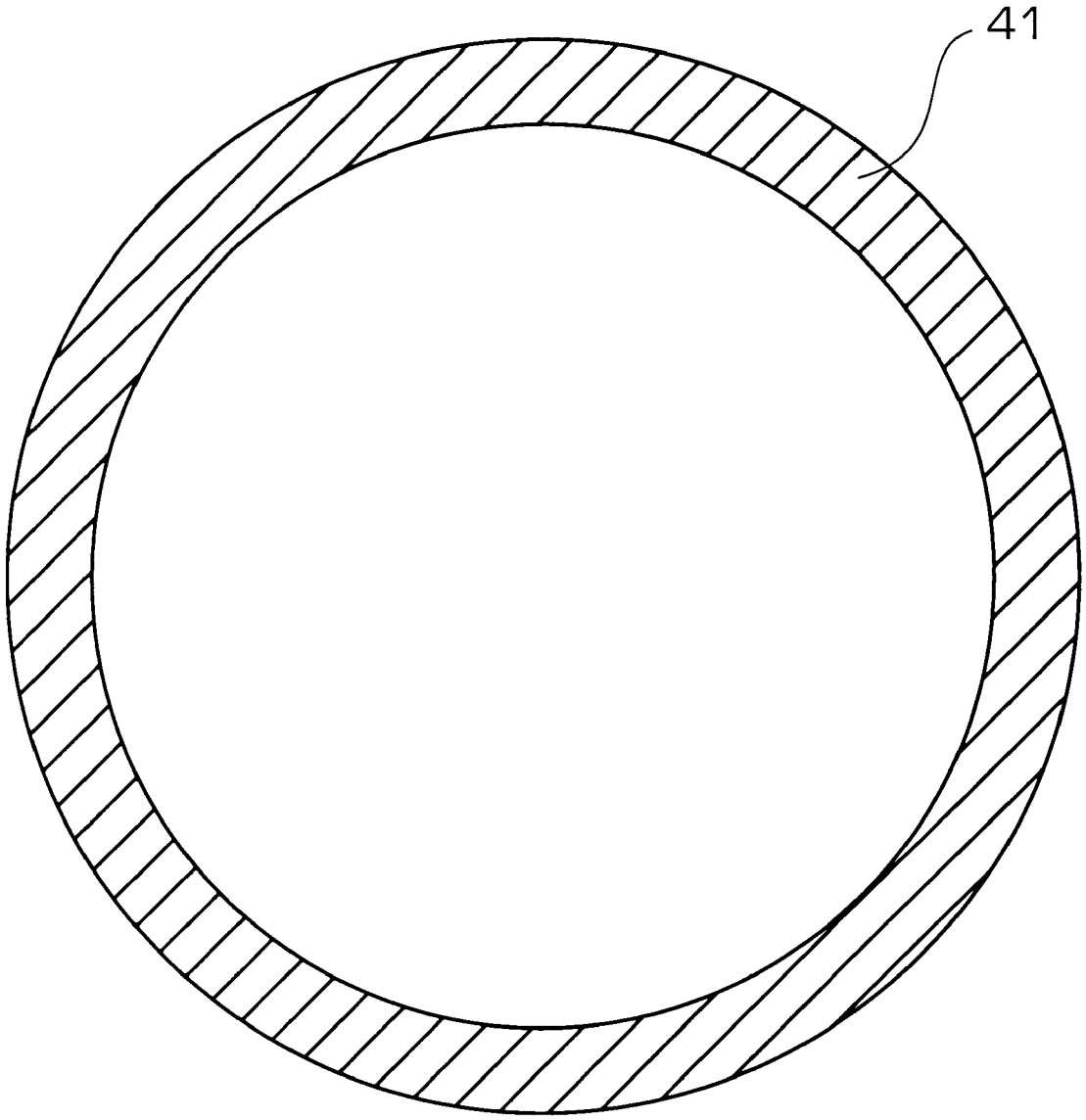
FIG. 5 is a horizontal direction sectional view of a spray form according to the above embodiment.
Figure 6:
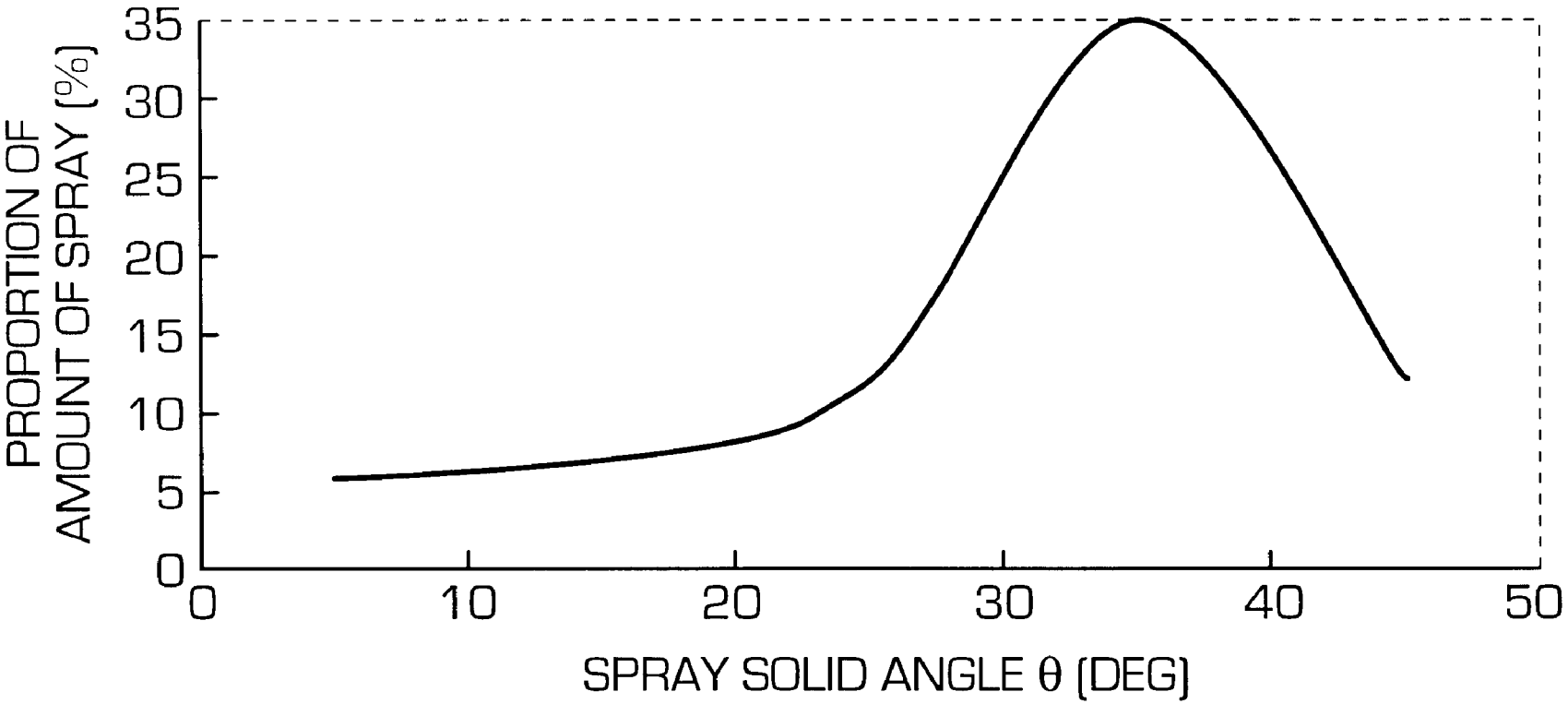
FIG. 6 is a diagram showing the measurement results of spray distribution according to the above embodiment.
Figure 7:
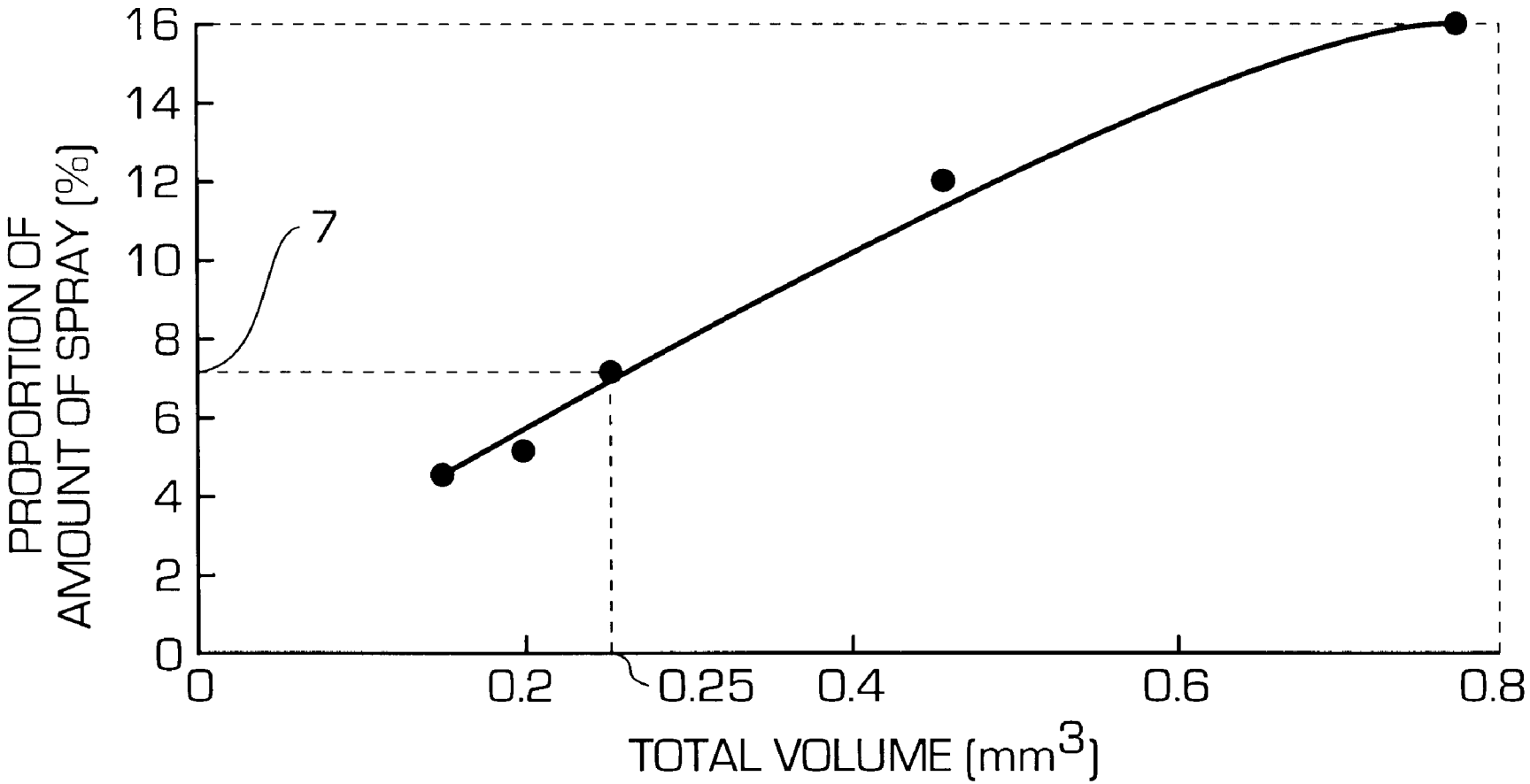
FIG. 7 is a diagram showing the measurement results of the proportion of center spray according to the above embodiment.
Figure 8:
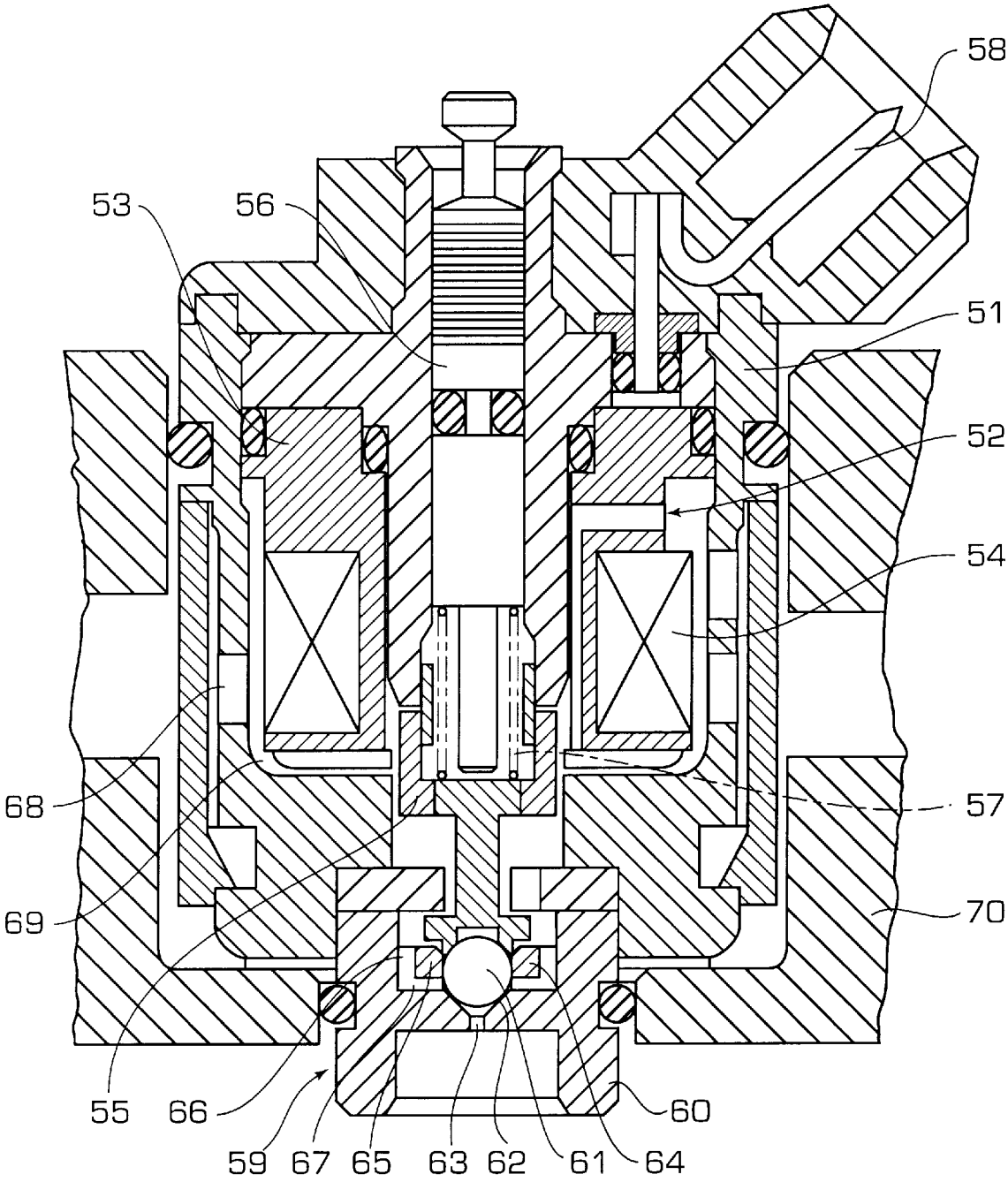
FIG. 8 is an axial direction sectional view of a fuel injection valve of the prior art.
Figure 9:
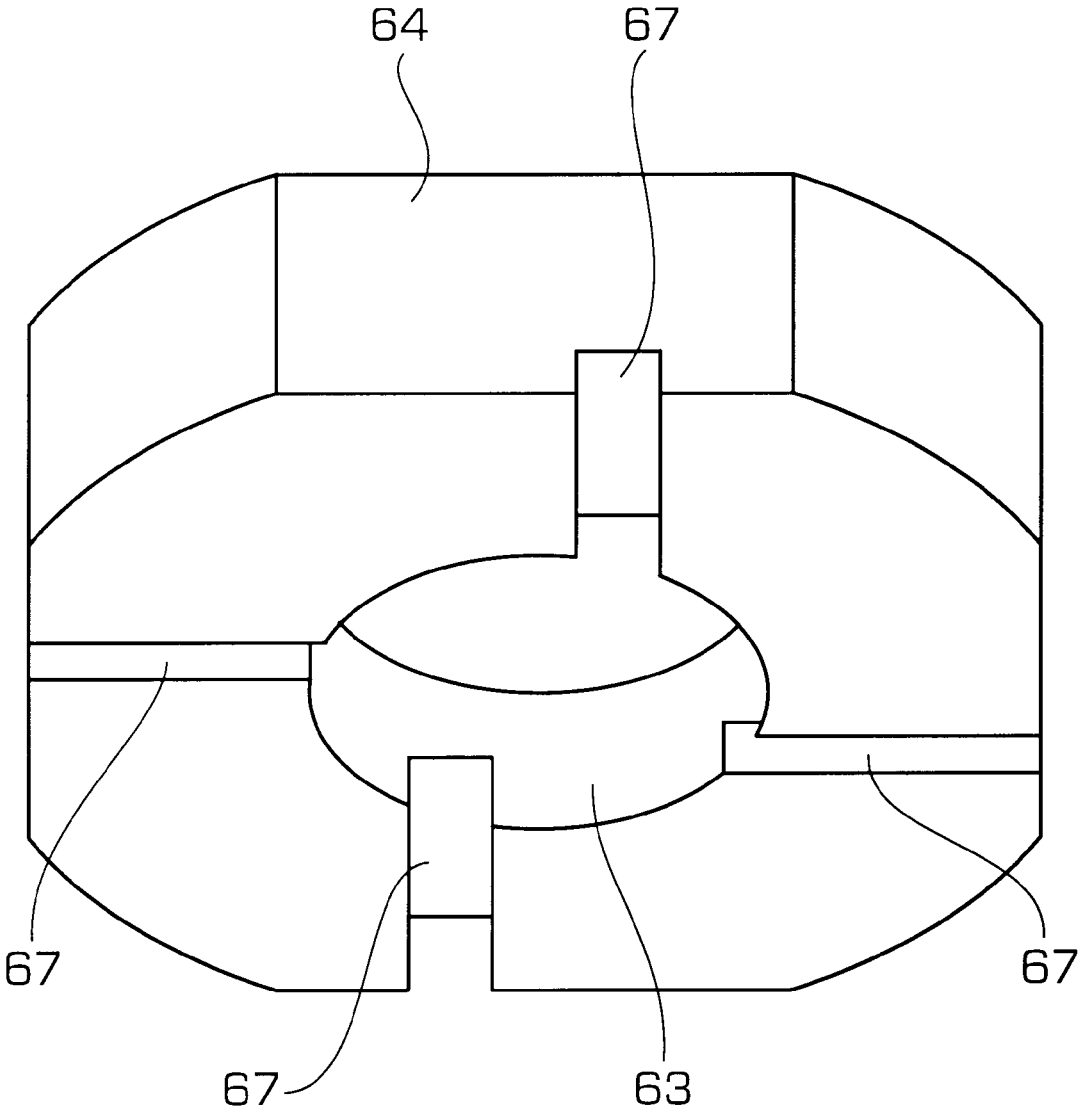
FIG. 9 PRIOR ART
FIG. 9 is a perspective view of a turning body in the fuel injection valve of FIG. 8.
Figure 10:
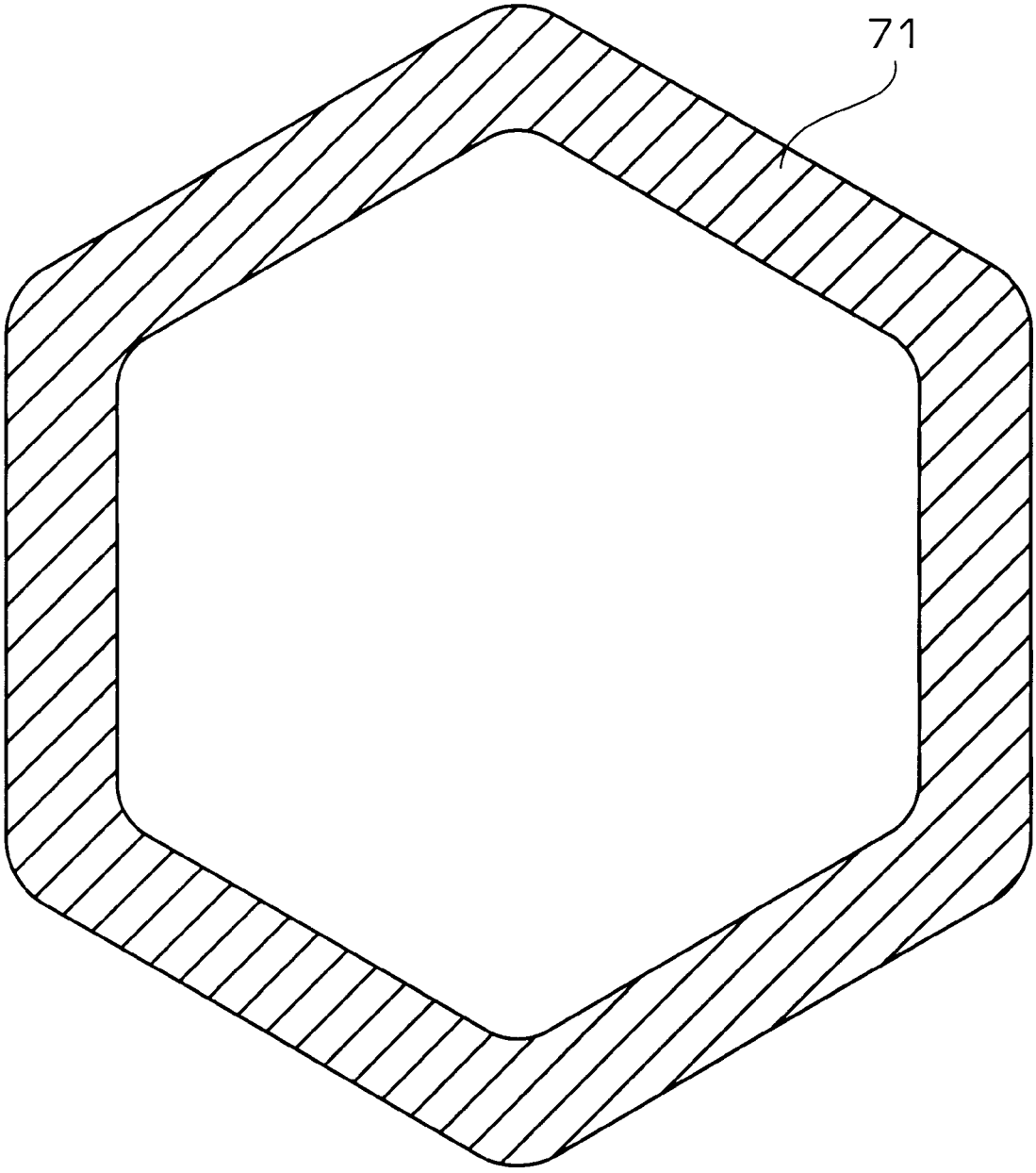
FIG. 10 PRIOR ART
FIG. 10 is a horizontal direction sectional view of the spray form of the fuel injection valve of FIG. 8.
Figure 11:
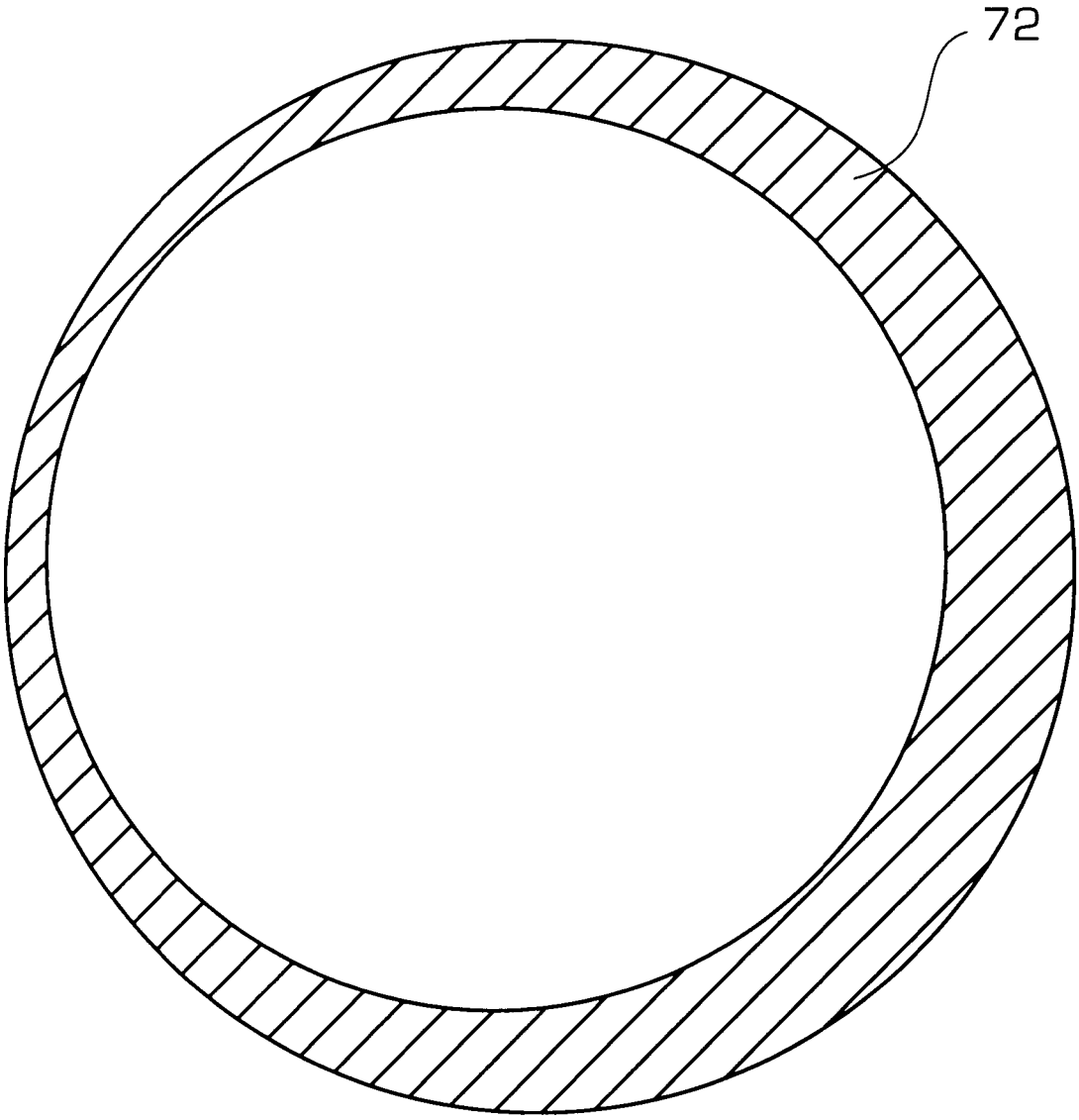
FIG. 11 PRIOR ART
FIG. 11 is a horizontal direction sectional view of another spray form of the fuel injection valve of FIG. 8.
Figure 12:
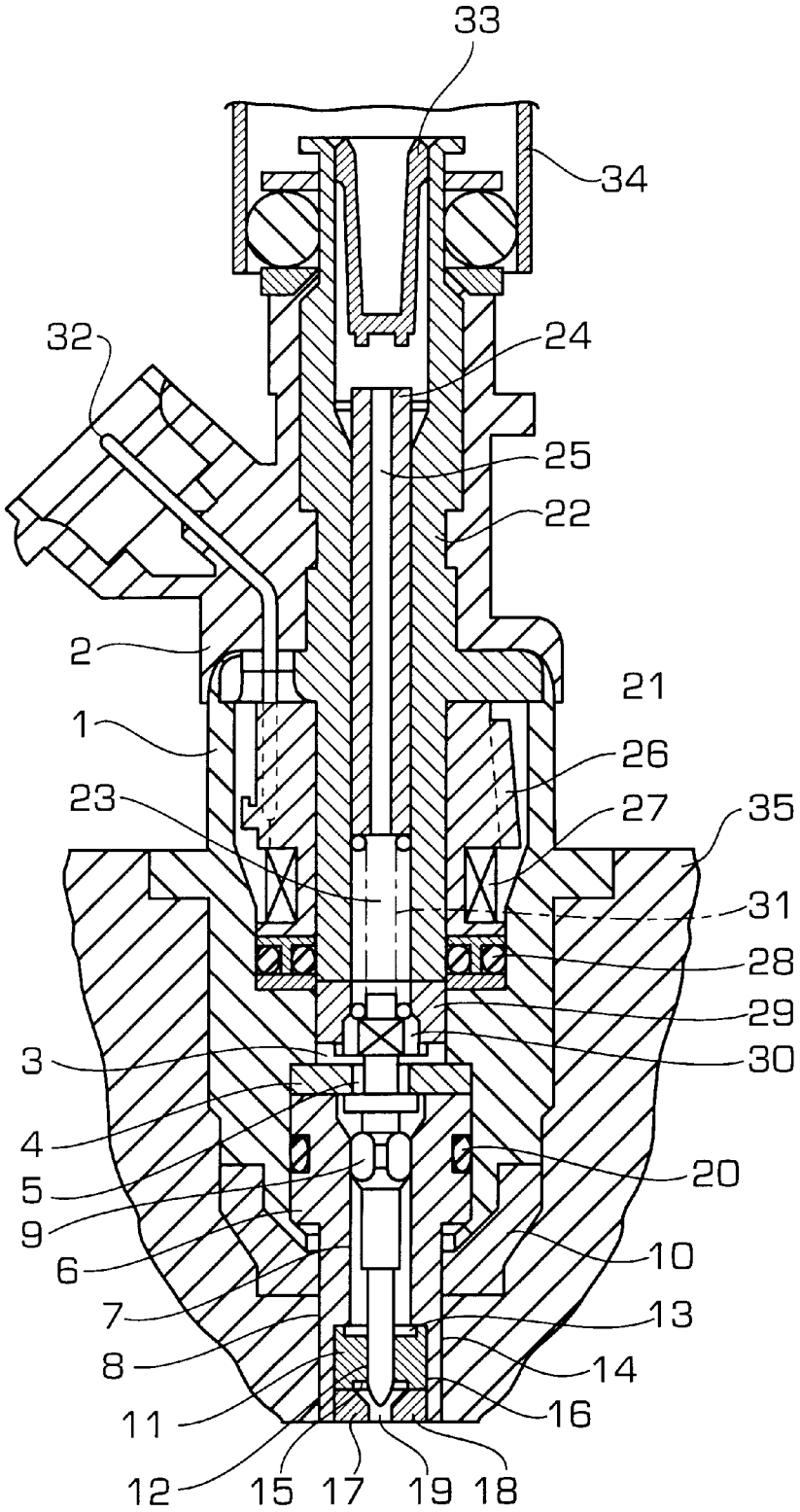
FIG. 12 PRIOR ART
FIG. 12 is an axial direction sectional view of a in-cylinder fuel injection valve of the prior art.
Figure 13:
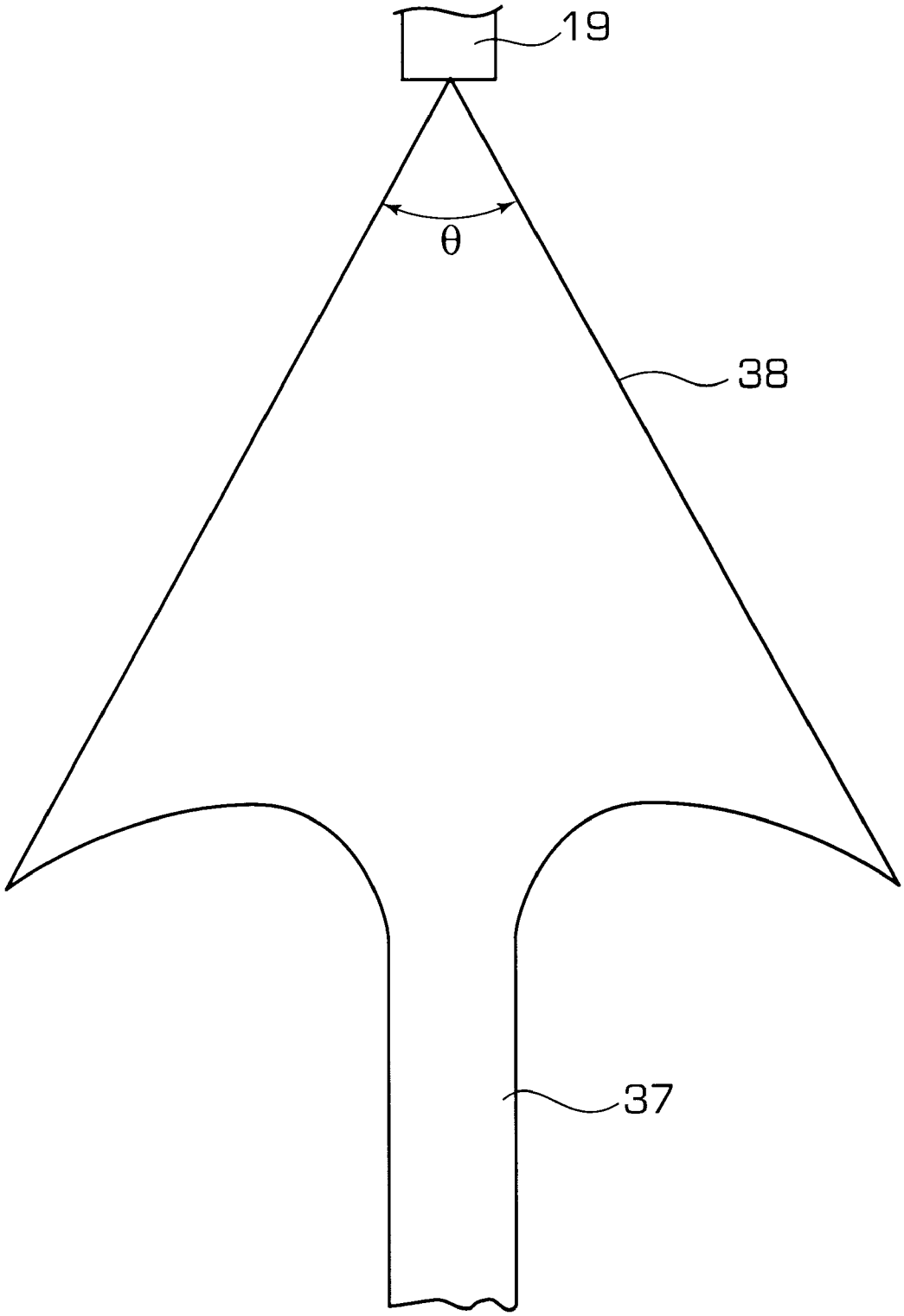
FIG. 13 PRIOR ART
FIG. 13 is an axial direction sectional view of the spray form of the in-cylinder fuel injection valve of FIG. 12.
Figure 14:
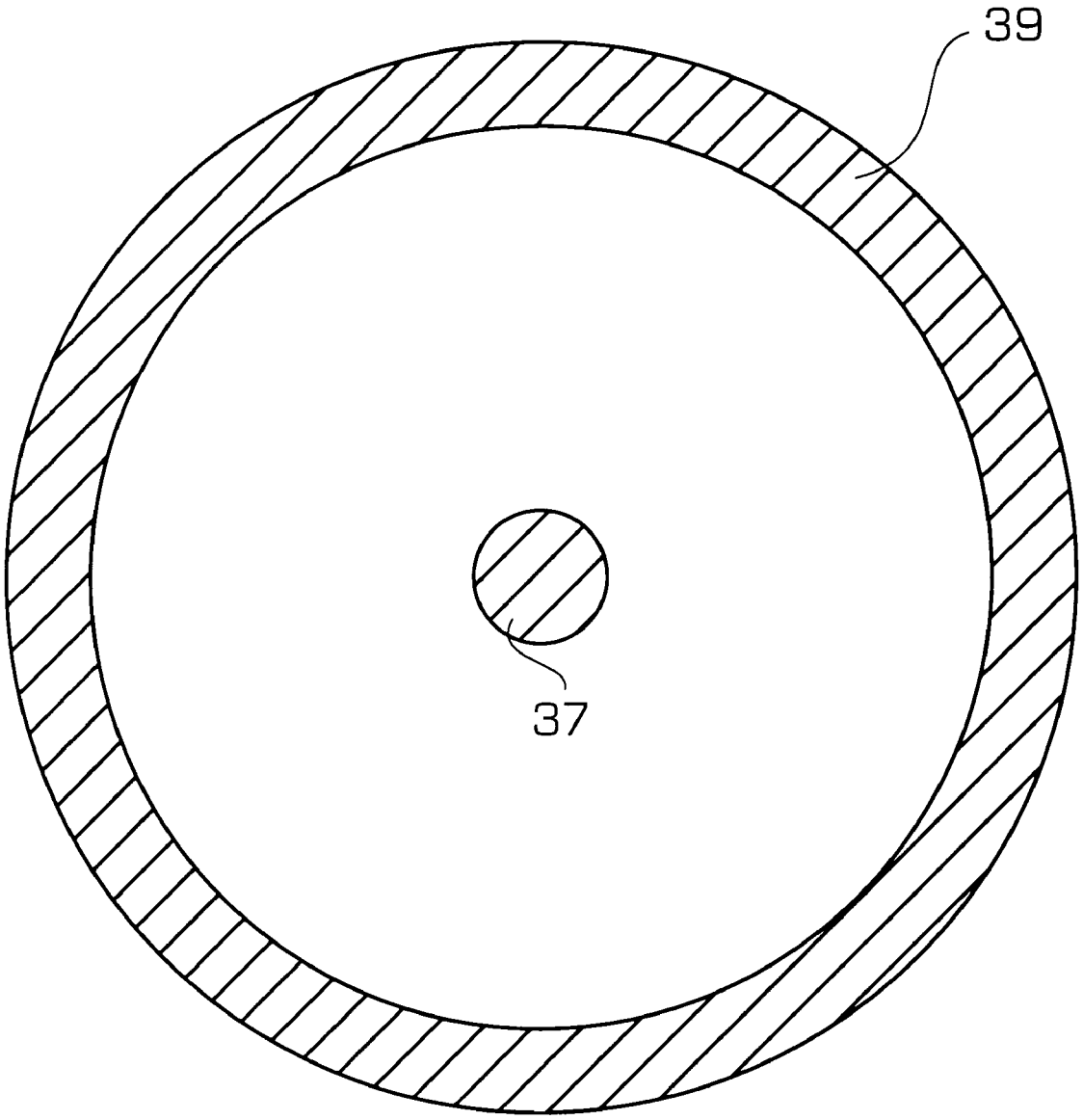
FIG. 14 PRIOR ART
FIG. 14 is a horizontal direction sectional view of the spray form of the in-cylinder fuel injection valve of FIG. 12.
Figure 15:
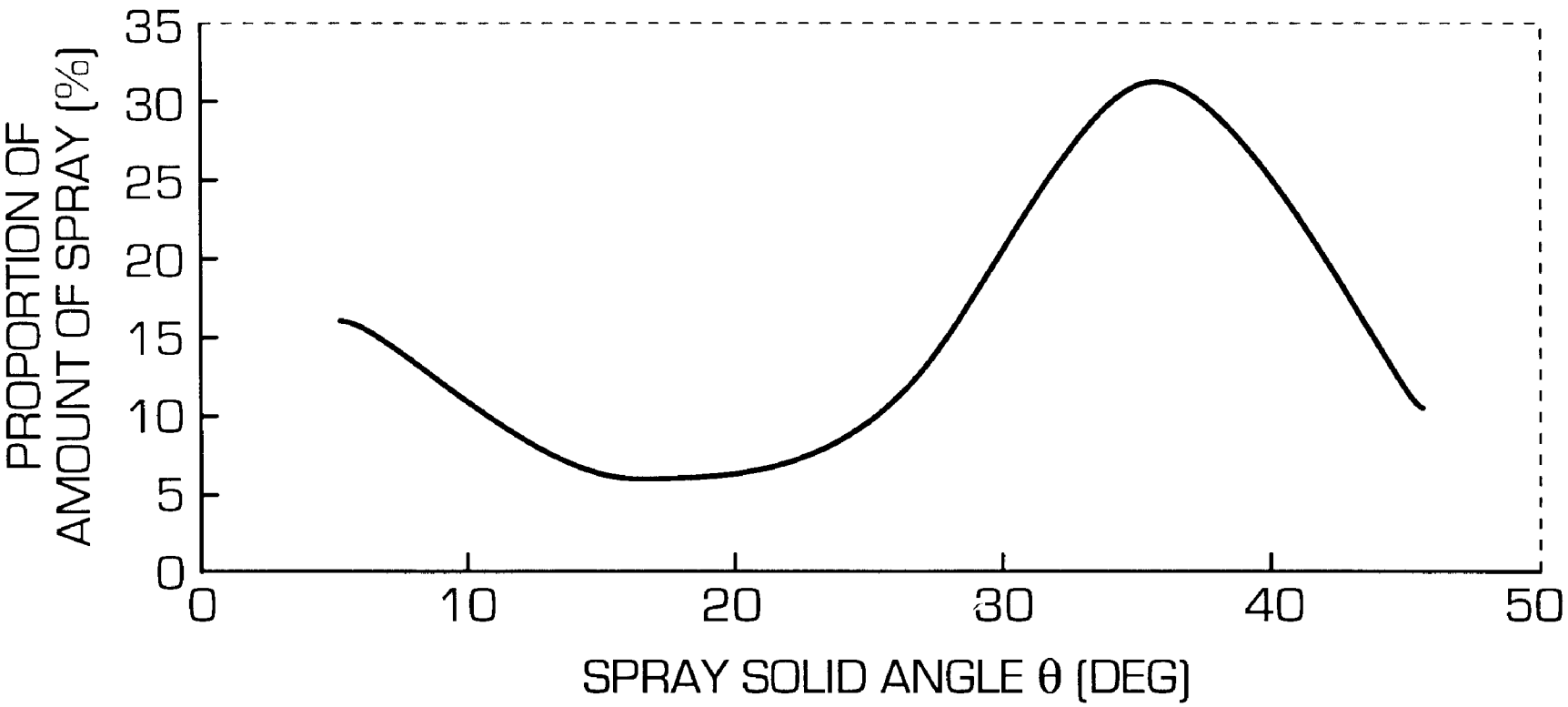
FIG. 15 PRIOR ART
FIG. 15 is a diagram showing the measurement results of spray distribution of the in-cylinder fuel injection valve of FIG. 12.

FIGS. 1 to 7 show a preferred embodiment of the present invention. FIG. 1 is an axial direction sectional view of an in-cylinder fuel injection valve, FIG. 2 is an axial direction sectional view of the end portion of a valve unit, FIG. 3 is a horizontal direction sectional view of the end portion of the valve unit, corresponding to a section cut on line A—A of FIG. 2, FIG. 4 is an axial direction sectional view showing the spray form of fuel injected, FIG. 5 is a horizontal direction sectional view showing the spray form of fuel injected, FIG. 6 is a diagram showing the characteristics of spray distribution and FIG. 7 is a diagram showing the characteristics of spray proportion. In FIG. 1, the in-cylinder fuel injection valve according to this embodiment is characterized in that a valve unit 311 corresponding to the above valve unit 3 has a turning body 111 in place of the above turning body 11 and a valve seat 171 in place of the above valve seat 17. Other elements such as the first valve housing 1, second valve housing 2, spacer 4, internal passage 5, valve body 6, internal passage 7, storage chamber 8, needle valve 9, holder 10, horizontal passage 14, turning grooves 16, injection port 19, sealing member 20, solenoid unit 21, core 22, internal passage 23, sleeve 24, internal passage 25, bobbin 26, electromagnetic coil 27, sealing member 28, armature 29, internal passage 30, spring 31, terminal 32 and filter 33 are the same as those of the prior art.

In FIGS. 2 and 3, the turning body 111 has in the center a center hole 121 for supporting the needle valve 9 as a valve in such a manner it can move therethrough, a first end surface 112 in contact with the valve seat 171, a second end surface 113 in contact with a shoulder portion 611 formed by a diameter difference between the internal passage 7 and the storage chamber 8 in the valve body 6, and a peripheral surface 114 in contact with the inner peripheral surface 81 of the storage chamber 8 in the valve body 6. An inner annular groove 151 and a plurality of turning grooves 16 are formed in the first end surface 112, a horizontal passage 13 is formed along the second end surface 113, and a vertical passage 14 is formed along the peripheral surface 114. The valve seat 171 has a cylindrical injection port 19 and a conical valve seat surface 181 in the center. The turning body 111 and the valve seat 171 are inserted into the storage chamber 8 sequentially, the second end surface 113 and the shoulder portion 611 are contacted to each other, the first end surface 112 and the valve seat 117 are contacted to each other, a contact portion between edge portions of the valve body 6 and the valve seat 171 is sealed up by welding 172 to prevent the leakage of fuel.

The needle valve 9, the center hole 121 and the inner annular groove 151 have the following dimensional relationship. When the outer diameter of a portion supported by the turning body 111 of the needle valve 9 is represented by D1, the inner diameter of the center hole 121 for supporting the needle valve 9 in the turning body 111 is represented by D2, and the inner diameter of the inner annular groove 151 is represented by D3, $2\times(D2-D1)<D3-D1$. Further, the total of the volume of the inner annular groove 151 and the volume of a space 182 surrounded by the valve seat surface 181, the first end surface 112 and the needle valve 9 while the needle valve 9 is in contact with the valve seat surface 181 (total of the volume of inner annular groove 151 and the volume of the space 182) is set to 0.25 $mm^3$ or less. When the diameter of an annular edge 183 intersecting a surface in contact with the turning body 111 of the valve seat 171 of the valve seat surface 181 is represented by D4, $D1<D2<D4<D3$. Although the size of D2–D1 is several microns and fuel does not flow in a space between the needle valve 9 and the center hole 121, the needle valve 9 can be moved in an axial direction by the electromagnetic attraction of the solenoid unit 21 (see FIG. 1) and the spring force of the spring 31 (see FIG. 1).

As shown in FIG. 3, the peripheral surface 114 of the turning body 111 is formed regular hexagonal. Apex angle portions 114*a*, 114*b*, 114*c*, 114*d*, 114*e* and 114*e* which are 6 peripheral surface portions of the peripheral surface 114 contact the inner peripheral surface 81 of the storage chamber 8 in the valve body 6. Six flat surfaces 114*g*, 114*h*, 114*i*, 114*j*, 114*k* and 114*m* of the peripheral surface 114 form arc-shaped spaces when seen from top with the inner peripheral surface 81 as a vertical passage 14. The turning grooves 16 are formed from the flat surfaces 114*g* to 114*m* to the inner annular groove 151. Out of opposed side surfaces sandwiching the turning grooves 16, 16*a*, 16*b*, 16*c*, 16*d*, 16*e* and 16*f* on one sides of the turning grooves 16 are in linear contact with the peripheral surface L1 of the inner annular groove 151. The turning grooves 16 are formed from the flat surfaces 114*g* to 114*m* to the inner annular groove 151 as parallel grooves having the same size. Since the depth of the inner annular groove 151 and the depth of each of the turning grooves 16 are made equal to each other, the outer peripheral surface L1 of the inner annular groove 151 becomes continuous with the turning grooves 16 and does not exist in fact. However, the peripheral surface L1 is depicted by a virtual line so that the viewer of FIG. 3 can recognize the peripheral surface 11 easily.

A description is subsequently given of the operation of this embodiment. Fuel is guided into the inner annular groove 151 from an unshown fuel pipe installed in the second valve housing 2 and the core 22 around the filter 33 through the filter 33, the internal passage 23 of the core 22, the internal passage 25 of the sleeve 24, the internal passage 30 of the armature 29, the internal passage 5 of the spacer 4, the internal passage 7 of the valve body 6, the horizontal passage 13, the vertical passage 14 and the turning grooves 16. When fuel flows into the inner annular groove 151 from the turning grooves 16 by the opening of the valve unit 3 caused by the electromagnetic attraction of the solenoid unit 21, fuel turns along the inner annular groove 151, passes through the annular space formed between the needle valve 9 and the valve seat surface 181 from the inner annular groove 151 and is injected from the injection port 19 in a conical spray form having a predetermined angle.

When the spray form of fuel injected from the injection port 19 in this embodiment was measured, the results shown in FIG. 4 and FIG. 5 were obtained. FIG. 4 is an axial direction sectional view showing the spray form of fuel injected from the injection port 19 and FIG. 5 is a horizontal direction sectional view showing the spray form of fuel injected from the injection port 19. In FIG. 4, the spray form 40 of fuel is a perfect hollow cone without center spray with the injection port 19 as a center. In FIG. 5, the spray form 41 of fuel is annular and uniform in width as shown by slant lines. Reviewing FIG. 4 and FIG. 5, the in-cylinder fuel injection valve according to this embodiment is constituted such that the turning grooves 16 are connected to the inner annular groove 151 tangentially as described above, the needle valve 9, the center hole 121 and the inner annular groove 151 have the dimensional relationship $2\times(D2-D1)<D3-D1$ as described above, and the total of the volume of the inner annular groove 151 and the volume of the space 182 is set to 0.25 $mm^3$ or less. Therefore, the amount of eccentricity between the needle valve 9 and the inner annular groove 151 during the opening of the valve is small, fuel running into the inner annular groove 151 from the turning grooves 16 becomes uniform in a circumferential direction, and the spray form of fuel injected from the injection port 19 does not become eccentric but uniform in a circumferential direction.

When the spray distribution of fuel injected from the injection port 19 in this embodiment was measured, the results shown in FIG. 6 were obtained. This measurement was carried out by placing a plurality of concentric jigs having different diameters at each spray solid angle θ (see FIG. 4) from the center of spray coaxial to the injection port 19, 50 mm away from the injection port 19 and right below the injection port 19. The amount of spray received by these jigs which receive the spray of fuel injected from the injection port 19 was measured. FIG. 6 is a diagram showing the results of this measurement, plotting the proportion of the amount of spray received by each jig at each spray solid angle θ to the total amount of spray received by all the jigs. It is understood from FIG. 6 that the proportion of the amount of spray gradually increases to 5.5 to 8% when the spray solid angle is 5 to 20°, sharply increases to 8 to 35% when the spray solid angle is 20 to 35°, becomes maximum at 35% when the spray solid angle is 35°, and sharply decreases to 35 to 12.5% when the spray solid angle is 35 to 45°.

When the relationship between the proportion of the amount of center spray having a spray solid angle θ of 10° or less and the above total volume (total of the volume of the inner annular groove 151 and the volume of the space 182) in this embodiment was measured, the results shown in FIG. 7 were obtained. This measurement was carried out by placing a single concentric jig at a spray solid angle of 10° from the center of spray coaxial to the injection port, 50 mm away from the injection port 19 and right below the injection port 19 and by changing the total volume to 0.175 $mm^3$, 0.2 $mm^3$, 0.25 $mm^3$, 0.425 $mm^3$ and 0.775 $mm^3$. The amount of center spray received by the above jig was measured. FIG. 7 is a diagram showing the results of this measurement, plotting the proportion of the amount of center spray received by the jig at each spray solid angle θ to the total amount of spray received by the jig. It can be understood from FIG. 7 that when the total volume is 0.25 $mm^3$ or less, the proportion of the amount of center spray is 7% or less. This is because fuel existent in the inner annular groove 151 and the space 182 does not turn and is injected ahead when the valve unit 311 is opened. However, since the total of the volume of the inner annular groove 151 and the volume of the space 182 is small at 0.25 $mm^3$ or less, the running force of fuel injected ahead is small and fuel is atomized immediately by shearing force with the ambient air.

Although the required amount of fuel at the time of idling differs according to the displacement of an internal combustion engine, the required amount of fuel at a dynamic range between the minimum flow rate during the opening of the valve unit 3 at the time of idling and the maximum flow rate during the opening of the valve unit 3 at the time of maximum revolution does not change so much even if the displacement of the internal combustion engine varies. Therefore, the required amount of fuel remains almost the same regardless of the displacement of the internal combustion engine during the opening of the valve unit at the time of idling. The amount of center spray at a spray solid angle of 10° or less remains almost the same regardless of the interval of the opening period of the valve unit 3. Therefore, the proportion of the amount of center spray to the total amount of spray becomes the largest when the flow rate is minimum. According to the measurement results of FIG. 7, when the total volume is 0.25 $mm^3$ or less, the proportion of the amount of center spray is 7% or less, thereby making it possible to obtain spray having no center spray in which fuel is not atomized substantially.

As described above, according to the present invention, when the outer diameter of a portion supported by the turning body of the valve in such a manner that it can move in an axial direction is represented by D1, the inner diameter of the center hole for supporting the valve in the turning body in such a manner that it can move in an axial direction is represented by D2 and the outer diameter of the inner annular groove formed in the valve seat side of the turning body coaxial to and surrounding the center hole is represented by D3, $2\times(D2-D1)<D3-D1$, and the total of the volume of the space surrounded by the valve seat, the turning body and the valve when the valve is closed and the volume of the inner annular groove is set to 0.25 $mm^3$ or less. Therefore, the amount of eccentricity of the valve from the inner annular groove is small, fuel flowing from the turning grooves into the inner annular groove becomes uniform in a circumrerential direction, the running force of fuel injected ahead at the start of the opening of the valve is small, and the fuel is atomized immediately by shearing force with the ambient air. Therefore, perfectly hollow conical spray can be realized with the minimum amount of center spray and the best combustion can be obtained even in an internal combustion engine which does not reflect the spray of fuel on the top face of the piston.

What is claimed is:

1. An in-cylinder fuel injection valve comprising:

a hollow housing body which can be connected to a fuel supply pipe;

a hollow cylindrical valve body installed in the housing body;

a valve seat provided at one end of the valve body and having an injection port for a fluid in the center;

a valve for opening and closing the injection port by contacting to and separating from this valve seat;

a hollow cylindrical turning body which surrounds and supports the valve in such a manner that it can move in an axial direction and installed in the valve body such that it is placed upon the valve seat to turn fuel flowing into the injection port;

a solenoid unit, installed in the housing body, for opening and closing the valve by contacting and separating the valve to and from the valve seat;

a plurality of peripheral surface portions of the turning body for specifying the location of the turning body relative to the valve body;

a vertical passage formed between the turning body and the valve body and between adjacent peripheral surface portions to form a passage of fuel in an axial direction;

a center hole formed in the turning body to surround and support the valve in such a manner that it can move in an axial direction;

an inner annular groove formed in the valve seat side of the turning body to surround the center hole coaxially; and turning grooves formed in the turning body such that they communicate with the inner annular groove and the vertical passage and are connected to the inner annular groove tangentially, wherein when the outer diameter of a portion of the valve supported by the turning body in such a manner that it can move in an axial direction is represented by D1, the inner diameter of the center hole is represented by D2 and the outer diameter of the inner annular groove is represented by D3, wherein said in-cylinder fuel injection valve has the dimensional relationship of $2\times(D2-D1)<D3-D1$, and wherein the total of the volume of a space surrounded by the valve seat, the turning body and the valve when the valve is closed and the volume of the inner annular groove is set to 0.25 $mm^3$ or less for realizing a hollow conical fuel spray with a minimum amount of center spray.

* * * * *